US012714186B2

(12) United States Patent
Despots Allaire et al.

(10) Patent No.: US 12,714,186 B2
(45) Date of Patent: Aug. 25, 2026

(54) MIDSOLE WITH VISCOELASTIC BLOCK ELEMENTS

(71) Applicant: ON CLOUDS GMBH, Zürich (CH)

(72) Inventors: Renaud Despots Allaire, Zürich (CH); Timon Kuhlenkamp, Zürich (CH)

(73) Assignee: ON CLOUDS GMBH, Zürich (CH)

( * ) Notice: Subject to any disclaimer, the term of this patent is extended or adjusted under 35 U.S.C. 154(b) by 0 days.

(21) Appl. No.: 18/682,044

(22) PCT Filed: Sep. 8, 2022

(86) PCT No.: PCT/EP2022/074954
§ 371 (c)(1),
(2) Date: Feb. 7, 2024

(87) PCT Pub. No.: WO2023/041412
PCT Pub. Date: Mar. 23, 2023

(65) Prior Publication Data

US 2024/0389711 A1 Nov. 28, 2024

(30) Foreign Application Priority Data

Sep. 14, 2021 (CH) ..... 70264/2021

(51) Int. Cl.
*A43B 13/12* (2006.01)
*A43B 5/06* (2022.01)
*A43B 13/18* (2006.01)

(52) U.S. Cl.
CPC ..... *A43B 13/125* (2013.01); *A43B 5/06* (2013.01); *A43B 13/187* (2013.01)

(58) Field of Classification Search
CPC ..... A43B 13/125; A43B 13/187; A43B 5/06
See application file for complete search history.

(56) References Cited

U.S. PATENT DOCUMENTS 2,833,057 A * 5/1958 Hack ..... A43B 13/184 D2/960
2,930,149 A * 3/1960 Hack ..... A43B 13/181 D2/960

(Continued)

FOREIGN PATENT DOCUMENTS

KR 20-2009-0009068 U 9/2009
WO WO 2016/191447 A1 12/2016

OTHER PUBLICATIONS

EPO (Rijswijk, NL), English version of the International Search Report, Form PCT/ISA/210, for International Application PCT/EP2022/074954, Nov. 24, 2022 (3 pp.).

*Primary Examiner* — Bao-Thieu L Nguyen
(74) *Attorney, Agent, or Firm* — Pauley Erickson & Swanson

(57) ABSTRACT

A midsole (1) for a running shoe extending in a longitudinal direction (L), a vertical direction (V) and a transverse direction (T), includes a plurality of separate viscoelastic block elements (41, 42, 43) being along the longitudinal direction (L) of the midsole (1) arranged one after the other, wherein the viscoelastic block elements (41, 42, 43) are separated from each other by a plurality of slits. The viscoelastic block elements (41, 42, 43) and the slits are configured such that the base layer (3) and the top layer (2) of the midsole (1) are along the longitudinal direction (L) of the midsole (1) sheared against each other upon exposure to forces occurring during running, which act against the longitudinal direction (L) of the midsole (1).

18 Claims, 4 Drawing Sheets

(56) References Cited

U.S. PATENT DOCUMENTS 2,968,105 A * 1/1961 Rizzo ..... A43B 13/20 36/77 R
3,005,272 A * 10/1961 Shelare ..... A43B 13/20 36/32 R
3,852,895 A * 12/1974 Funck ..... A43B 7/36 36/103
3,947,979 A * 4/1976 Sidles ..... A43B 13/184 36/32 R
4,777,738 A * 10/1988 Giese ..... A43B 5/08 D2/953
5,713,140 A * 2/1998 Baggenstoss ..... A43B 13/206 36/28
6,393,732 B1 * 5/2002 Kita ..... A43B 13/203 36/102
6,438,870 B2 * 8/2002 Nasako ..... A43B 13/181 36/114
6,691,432 B2 * 2/2004 Masseron ..... A43B 13/184 36/31
7,047,672 B2 * 5/2006 Hoffer ..... A43B 13/223 36/114
7,204,044 B2 * 4/2007 Hoffer ..... A43B 13/143 36/114
8,914,998 B2 * 12/2014 Gheorghian ..... A43B 13/141 36/103
9,480,298 B2 * 11/2016 Barnes ..... A43B 17/003
9,999,274 B2 * 6/2018 Henderson ..... A43B 3/0057
10,856,610 B2 * 12/2020 Ng ..... A43B 17/023
12,064,002 B2 * 8/2024 Jensen ..... B29D 35/082
2007/0169376 A1 * 7/2007 Hatfield ..... A43B 7/1415 36/35 B
2007/0169379 A1 * 7/2007 Hazenberg ..... A43B 13/141 36/102
2012/0204449 A1 * 8/2012 Stockbridge ..... A43B 13/04 36/103
2012/0210606 A1 * 8/2012 Gheorghian ..... A43B 13/127 36/103
2014/0150297 A1 6/2014 Holmes et al.
2015/0101215 A1 4/2015 Henderson et al.
2015/0250260 A1 * 9/2015 Bessho ..... A43B 7/18 36/25 R
2017/0202304 A1 * 7/2017 Ng ..... A43B 13/184
2017/0325544 A1 * 11/2017 Ngene ..... A43B 13/148
2020/0093221 A1 * 3/2020 Caldwell ..... A43B 3/0036
2021/0186143 A1 * 6/2021 Beck ..... A43B 7/148
2023/0140074 A1 * 5/2023 Bernhard ..... A43B 13/183 36/28
2024/0081476 A1 * 3/2024 Zheng ..... A43B 13/188
2024/0298745 A1 * 9/2024 Altrogge ..... A43B 13/186

* cited by examiner

MIDSOLE WITH VISCOELASTIC BLOCK ELEMENTS

CROSS REFERENCE TO RELATED APPLICATION

This application is a National Phase filing in the United States, under 35 USC § 371, of PCT International Patent Application PCT/EP2022/074954, filed on 8 Sep. 2022 which claims the priority of Swiss Patent Application No. CH 070264/2021, filed 14 Sep. 2021.

The above-referenced applications are hereby incorporated by reference herein in their entirety and are made a part hereof, including but not limited to those portions which specifically appear hereinafter.

BACKGROUND OF THE INVENTION

Field of the Invention

The present invention relates to cushioning systems for running shoes, in particular, to a midsole for a running shoe.

Discussion of Related Art

A large number of running shoes with different cushioning systems is known in the state of the art. Sports and leisure shoes with soles that have a gel core in the heel area to ensure vertical cushioning during footfall, i.e. tread, are widely used. In addition, improvements in vertical cushioning properties have been achieved by placing individual spring elements in the heel area between the outsole and the insole.

While the above-mentioned soles improve the vertical cushioning properties of the shoes, satisfactory cushioning of forces acting horizontally on the sole and the shoe cannot satisfactorily be achieved. Forces with a large horizontal component are additionally enhanced especially on inclined routes, and due to a lack of sufficient cushioning they represent one of the main causes of frequently occurring knee and hip joint pain. Therefore, midsoles allowing for an improved cushioning are desirable.

SUMMARY OF THE INVENTION

It is a general object of the present invention to advance the state of the art regarding midsoles for running shoes and preferably to provide a midsole allowing for improved cushioning, in particular of forces acting horizontally on the shoe and thus on the foot of the runner. In advantageous embodiments, a midsole is provided, which provides not only an improved cushioning, but also a secure stand and footstep. In further advantageous embodiments, a midsole is provided which allows for sufficient cushioning and additionally prevents major energy losses during push-off.

The general objective is achieved by the subject-matter of the independent claim. Further advantageous embodiments follow from the dependent claims and the overall disclosure.

In a first aspect, a midsole for a running shoe is provided, which extends in a longitudinal direction, a vertical direction and a transverse direction. The midsole comprises a top layer and a base layer delimiting the midsole in the vertical direction, a heel edge and a sole tip delimiting the midsole in the longitudinal direction, and a medial side and a lateral side delimiting the midsole in the transverse direction. In other words, along the longitudinal direction, the midsole extends from the heel edge to the sole tip. In the vertical direction, the midsole extends from the base layer to the top layer. In the transverse direction, the midsole extends from the medial side to the lateral side. The midsole further comprises a plurality of separate viscoelastic block elements, which are along the longitudinal direction of the midsole arranged one after the other, i.e. are arranged consecutively. The viscoelastic block elements are separated from each other by a plurality of slits. Each slit of the plurality of slits extends in the transverse direction from the medial side of the midsole to the lateral side of the midsole. Furthermore, the viscoelastic block elements and the slits are configured such that the base layer and the top layer of the midsole are along the longitudinal direction of the midsole sheared, i.e. shearable, against each other, thereby decreasing the distance between directly adjacent viscoelastic block elements, e.g. between at least two or between all directly adjacent viscoelastic block elements, upon exposure to forces occurring during running, which act against the longitudinal direction of the midsole. Due to the shearing function of the base layer with respect to the top layer, the distance between directly adjacent viscoelastic block elements, i.e.: the corresponding slit, is decreased, which allows to efficiently absorb not only vertical forces but specifically forces acting horizontally against the longitudinal direction of the midsole and the runner's foot, which thus prevents the occurrence of hip and knee joint injuries.

The viscoelastic block elements may typically comprise a hardness of 30 to 60 Asker C, in particular 40 to 50 Asker C.

In some embodiments, the viscoelastic block elements may be elastic block elements.

Typically, at least some or all of the slits each extends in the transverse direction from the medial side to the lateral side of the midsole through the complete midsole.

The viscoelastic block elements are typically protruding from the top layer against the vertical direction of the midsole. Separate viscoelastic block elements are elements which are spatially separated from each other by a corresponding slit and which are thus typically movable independently of each other. The slits are typically empty, i.e. unfilled. A block element extends typically completely from the medial side to the lateral side of the midsole. This does however not exclude that a viscoelastic block element may along the transverse direction be divided into two or more portions, for example by a groove extending in the longitudinal direction of the midsole. However, along the longitudinal direction a viscoelastic block element may be delimited by two slits, respectively a slit and the heel edge or a slit and the sole tip for the last and first viscoelastic block element of the midsole. The term "directly adjacent viscoelastic block elements" therefore refers to two viscoelastic block elements which are along the longitudinal direction arranged one after the other and which are separated by a corresponding slit.

The slits are in the operative state, i.e. the worn state, in which the midsole is part of a running shoe, open towards the ground. However, the slits are no through slits, i.e. they do not extend, respectively protrude the midsole, completely from the base layer to the top layer. A slit starts from the base layer and extends towards the top layer but does typically not reach the top layer. The slits are typically defined by two directly adjacent viscoelastic block elements.

In some embodiments, each of the slits has an opening on the lateral side and an opening on the medial side of the midsole.

Directional indications as used in the present disclosure are to be understood as follows: The longitudinal direction L of the midsole is described by an axis from the heel area, respectively from the heel edge, to the forefoot region, respectively to the sole tip, and thus extends along the longitudinal axis of the midsole. The transverse direction T of the midsole extends transversely to the longitudinal axis and substantially parallel to the bottom layer of the midsole, or substantially parallel to the ground in the operative state. Thus, the transverse direction runs along a transverse axis of the midsole. In the context of the present invention, the vertical direction V denotes a direction from the bottom layer to the top layer of the midsole in the direction of the insole, or in the operative state in the direction of the foot of the wearer, and thus runs along a vertical axis of the midsole. The longitudinal direction, the vertical direction and the transverse direction may all be perpendicular to each other. The lateral side of the midsole is the outer perimeter of the midsole between the heel edge and the sole tip, which in the worn state rests against the outer instep of the wearer's foot. The medial side of the midsole refers to the inner perimeter of the midsole between the heel edge and the sole tip, which is located opposite the lateral side. Thus, in a pair of worn running shoes, the medial sides of the two running shoes face each other and the lateral sides face away from each other. Furthermore, the midsole may typically along the longitudinal direction be divided into a forefoot area, a heel area and a midfoot area being arranged between the forefoot area and the heel area. For example, the forefoot area extends from the sole tip against, i.e. opposite, the longitudinal direction to 30-45% of the total length of the midsole in the longitudinal direction. The heel area extends, for example, from the heel edge in the longitudinal direction to 20-30% of the total length of the midsole in the longitudinal direction. The midfoot area extends directly between the heel area and the forefoot area, such that the length in the longitudinal direction of the midfoot area makes up the remaining portion of the total length, particularly from 15-50% of the total length.

The midsole may in some embodiments comprise at least 3, at least 4, at least 5, at least 6, at least 7, at least 8, at least 9, or at least 10 viscoelastic block elements being along the longitudinal direction of the midsole arranged one after the other. As two viscoelastic block elements are separated from each other by a slit, the midsole may thus comprise at least 2, at least 3, at least 4, at least 5, at least 6, at least 7, at least 8, or at least 9 slits. In particular embodiments, the midsole may comprise between 3 to 16 viscoelastic block elements and therefore between 2 to 15 slits, in particular between 8 to 12 viscoelastic block elements and therefore between 7 to 11 slits.

The midsole, and in particular the viscoelastic block elements, may fully or partly, in particular its majority, i.e. more than 50% of its volume, be made from a foamed polymer. Particular suitable materials include ethylene-vinyl acetate, thermoplastic polyurethane, polyolefins, polyesters, polyamides, polyether block amide and mixtures thereof.

In some embodiments, the midsole may be a single piece midsole. In other embodiments, the midsole may be a two-piece midsole. A two-piece midsole may for example comprise of a midsole upper portion and a midsole lower portion, which are arranged above each other, i.e. with are arranged in the vertical direction above each other. It may further be possible that additional sole elements are arranged between the midsole upper portion and the midsole lower portion, such as an elastic rigid plate. Alternatively, the midsole upper portion may be directly arranged on top of midsole lower portion. In certain embodiments, the plurality of slits, or at least some of these slits, extend through the midsole lower portion into the midsole upper portion.

The midsole, and in specific embodiments also the midsole upper portion and the midsole lower portion, may in some embodiments have a hardness of 30 to 60 Asker C, in particular of 40 to 50 Asker C.

In some embodiments, some or all of the viscoelastic block elements and the slits are configured such that the base layer and the top layer of the midsole are along the longitudinal direction of the midsole sheared against each other until directly adjacent viscoelastic block elements contact each other, in particular under closure of the slit separating, i.e. initially separating, the directly adjacent viscoelastic block elements, upon exposure to forces occurring during running, which act against the longitudinal direction of the midsole. The contact of two directly adjacent viscoelastic block elements leads to a frictional lock. This provides a stabilizing effect for the runner and allows for an efficient push-off without losing much energy. The forces acting during running can be determined by the procedure described with respect to FIG. 5 herein.

In some embodiments, the viscoelastic block elements and the slits are configured such that upon exerting a vertical force of 1000 N to 1700 N onto the midsole, a vertical deformation, i.e. a deformation of the vertical extension of the midsole along the vertical direction, of 25% to 50% occurs. It is understood that this deformation is measured relative to the unstressed state. In certain embodiments, the viscoelastic block elements in the midfoot area and the slits in the midfoot area are configured such that upon exerting a vertical force of 1500 N to 1700 N onto the midsole, a vertical deformation. i.e. a deformation of the vertical extension of the midsole along the vertical direction, of 40% to 50% occurs. In certain embodiments, the viscoelastic block elements in the heel area and the slits in the heel area are configured such that upon exerting a vertical force of 1000 N to 1200 N onto the midsole, a vertical deformation, i.e. a deformation of the vertical extension of the midsole along vertical direction V, of 20% to 30% occurs. These forces and the deformation can be obtained by the procedure described with respect to FIG. 5 herein.

In some embodiments opening of each slit at the base layer is in the longitudinal direction offset to an end of the corresponding slit. That is, the end of the corresponding slit is arranged closer to the sole tip than the opening at the base layer.

In some embodiments, each viscoelastic block element comprises a front flank delimiting the viscoelastic block element in the longitudinal direction and a rear flank delimiting the viscoelastic block element against the longitudinal direction. Thus, the front flank of a viscoelastic block element may be arranged closer to the sole tip than the rear flank of this viscoelastic block element. Vice versa, the rear flank of a viscoelastic block element may be arranged closer to the heel edge than the front flank of this viscoelastic block element. A flank is typically a surface, in particular a planar surface. The front flank and the rear flank of at least a portion, or of at least two, or of at least three, or of at least the majority, i.e. more than 50%, or of all, of the viscoelastic block elements extend, particularly linearly extend, from the base layer in the vertical direction towards the top layer of the midsole and in the longitudinal direction towards the sole tip. In other words, each slit of such viscoelastic block elements extends from its corresponding location of origin at the base layer vertically towards its end location which is in the longitudinal direction positioned closer to the sole tip than the location of origin. In certain embodiments, the front flank and the rear flank of the corresponding viscoelastic block elements extend such that the corresponding slits each extend in the cross-section along the longitudinal direction of the midsole and perpendicular to the transverse direction of the midsole both along the vertical direction of the midsole and along the longitudinal direction of the midsole.

In some embodiments, at least a portion, or at least two, or at least three, or at least the majority, i.e. more than 50%, or all, of the viscoelastic block elements each has/have in the cross-section along the longitudinal direction of the midsole and perpendicular to the transverse direction of the midsole a shape of a trapezoid, in particular of a parallelogram. Typically, however, a trapezoid shape as used herein may exclude a rectangular or quadratic shape. Therefore, the angles between two adjacent sides is typically not 90°.

In some embodiments, the front flank and the rear flank of at least one, or of at least two, or of at least three, or of at least the majority, i.e. more than 50%, or of all, of the viscoelastic block elements are arranged in parallel to each other.

In some embodiments, the front flank of a first viscoelastic block element and the rear flank of a directly adjacent second viscoelastic block element which is positioned closer to the sole tip than the first viscoelastic block element, each comprise a corresponding shape. Such corresponding shapes are shaped complementary to each other, respectively are configured such that they can contact each other over their whole surfaces, particularly in an equal manner. An example is a convexly shaped spherical front flank and a complementary shaped concave rear flank. Such embodiments enable an additional form lock or at least a higher frictional lock when the slits are completely closed and the flanks contact each other, thereby allowing a secure stand and footstep.

In some embodiments, the front flank of a first viscoelastic block element extends in parallel to the rear flank of a directly adjacent second viscoelastic block element which is positioned closer to the sole tip than the first viscoelastic block element. This ensures that the two corresponding viscoelastic block elements can contact each other over the full front and rear flank.

In some embodiments, the length of each of the viscoelastic block elements, i.e. the distance between its front flank and rear flank is between 5 mm to 30 mm, in particular between 15 mm and 25 mm.

In some embodiments, the length of each of the viscoelastic block elements may vary or remain constant along the longitudinal direction from viscoelastic block element to viscoelastic block element.

In some embodiments, the angles between the rear flank and the base layer of the viscoelastic block elements vary from one viscoelastic block element to the next adjacent viscoelastic block element in the longitudinal direction, i.e. from the heel edge of the midsole to sole tip. For example, in certain embodiments, the angles between the rear flank and the base layer of the viscoelastic block elements may from the heel tip along the longitudinal direction first decrease or remain constant from one viscoelastic block element to the directly adjacent one until a minimum angle is reached in the midfoot area and/or in the forefoot area and then the angles between the rear flank and the base layer of the viscoelastic block elements may increase or remain constant towards the sole tip. Such embodiments have the advantage that the horizontal cushioning effect can be increased in areas in which it is required the most. Furthermore, the smaller the angle between the rear flank and the base layer, the easier the corresponding adjacent viscoelastic block elements come into contact with each other, thereby allowing an efficient cushioning. In specific embodiments, the angles between the rear flank and the base layer may from the heel tip along the longitudinal direction first decrease or remain constant from one viscoelastic block element to the directly adjacent one until a minimum angle is reached in the midfoot area and then the angles between the rear flank and the base layer of the viscoelastic block elements may increase towards the sole tip. In certain embodiments, the angle between the rear flank and the base layer of the viscoelastic block elements in the forefoot area is between 60° and 90°, particularly between 65° and 85°. Thus, in such embodiments, the slits between corresponding two of such viscoelastic block elements extends almost in the vertical direction. This allows for providing a stable stand and thus an efficient push-off.

In some embodiments, the angles between the front flank and the base layer of the viscoelastic block elements vary from one viscoelastic block element to the next adjacent viscoelastic block element in the longitudinal direction from the heel edge of the midsole to sole tip. For example, in certain embodiments, the angles between the front flank and the base layer of the viscoelastic block elements may from the heel tip along the longitudinal direction first increase or remain constant from one viscoelastic block element to the directly adjacent one until a maximum angle is reached in the midfoot area and/or in the forefoot area and then the angles between the front flank and the base layer of the viscoelastic block elements may decrease or remain constant towards the sole tip. Such embodiments have the advantage that the horizontal cushioning effect can be increased in areas in which it is required the most. Furthermore, the larger the angle between the front flank and the base layer, the easier the corresponding adjacent viscoelastic block elements come into contact with each other, thereby allowing an efficient cushioning. In specific embodiments, the angles between the front flank and the base layer of the viscoelastic block elements may from the heel tip along the longitudinal direction first increase or remain constant from one viscoelastic block element to the directly adjacent one until a maximum angle is reached in the midfoot area and then the angles between the front flank and the base layer of the viscoelastic block elements may decrease towards sole tip. In certain embodiments, the angle between the front flank and the base layer of the viscoelastic block elements in the forefoot area is between 90° and 120°, particularly between 90° and 115°. Thus, in such embodiments, the slits between corresponding two of such viscoelastic block elements extends almost in the vertical direction. This allows for providing a stable stand and thus an efficient push-off.

In some embodiments, the angle between the rear flank and the base layer is between 15° to <90°, particularly between 25° to 65°.

In some embodiments, the angle between the front flank and the base layer is between 165° to >90°, particularly between 155° to 115°.

In some embodiments, the slits have a varying depth, i.e. from slit to slit along the longitudinal direction. This means, a first slit may have a first depth, which is constant over the first slit, and a second slit being positioned closer to the sole tip or closer to the heel edge than the first slit may have a second depth, which is constant over the second slit, but which is different from the first depth. For example, each slit may have a different depth than any other slit. It may also be possible that certain slits have the same depth, while only some other slits or only a single other slit have/has a different depth. As the skilled person understands, the depth is the distance from the location of origin of the slit at the base layer, i.e. its opening, to the end location of the corresponding slit, which is closer to the top layer and typically also offset in the longitudinal direction.

In certain embodiments, the depth of the slits may first increase or remain constant from one slit to the next one along the longitudinal direction until a maximum depth is reached in the midfoot area and/or in the forefoot area and then the depth of the slits may decrease or remain constant towards the sole tip.

In some embodiments, the depth of at least a portion of the slits, e.g. of a single slit, of a majority of the slits, i.e. more than 50% of the slits, or of all of the slits is larger than 30%, particularly larger than 50%, of the thickness of the midsole. The thickness of the midsole refers to the distance along the vertical direction between the base layer and the top layer of the midsole. In certain embodiments, the depth of at least a portion of the slits, e.g. of a single slit, of a majority of the slits, i.e. more than 50% of the slits, or of all of the slits is between 50% and 95%, particularly between 50% and 90%, particularly between 60% and 90%, of the thickness of the midsole.

In some embodiments, the depth of at least a single slit, or of the majority of the slits is at least 5 mm, in particular at least 7 mm, in particular at least 10 mm, in particular at least 20 mm.

In some embodiments, at least some of, or all of the viscoelastic block elements are massive viscoelastic block elements, i.e. they are themselves closed on the medial side and on the lateral side of the midsole.

In some embodiments, a ratio between a total closed area and a total open area being defined by the slits along the lateral side of the midsole or along the medial side of the midsole is between 0.95:0.05 to 0.75:0.25, in particular between 0.92:0.08 to 0.88:0.12. Such ratios provide for a sufficiently stable stand, even if the runner is not moving but standing still, but also allows for sufficient damping of the horizontally acting forces during running.

In some embodiments, the midsole further comprises an elastic rigid plate. The elastic rigid plate may be incompressible. Such a plate may extend at least along 50%, particularly along at least 60%, particularly along at least 75%, particularly along at least 85%, particularly along 90%, particularly along 95% or along 100% in the longitudinal direction and/or the transverse direction of the midsole. The elastic rigid plate is typically stiffer and thus more rigid than the rest of the midsole. The effect of such a plate is a propelling effect, because the plate is elastically deformed upon footstep and thus strained and returns to its original unstrained state upon push-off.

In some embodiments, the flexural strength of the elastic rigid plate may be between 300 MPa to 13000 MPa.

In some embodiments, the elastic rigid plate may have a higher rigidity than the rest of the midsole.

The elastic rigid plate may typically have a thickness of 0.5 mm to 3 mm, particularly of 0.8 mm to 2 mm.

The elastic rigid plate may for example be made of thermoplastic polyurethanes, polyolefins, polyesters, polyamides, polyether block amide, carbon, or combinations thereof.

The elastic rigid plate may in some embodiments delimit the midsole in the vertical direction. Thus, in such embodiments, the top layer of the midsole is formed by the top layer of the elastic rigid plate.

In some embodiments, the elastic rigid plate divides the midsole in a midsole upper portion and a midsole lower portion, wherein the elastic rigid plate is in the vertical direction arranged between the midsole upper portion and the midsole lower portion. Along the vertical direction of the midsole, i.e. as seen from the base layer, the midsole lower portion is arranged first, followed by the elastic rigid plate, followed by the midsole upper portion. Arranging the plate between the midsole lower portion and the midsole upper portion has the advantage that the midsole upper portion provides a cushioning effect towards the rigid, and thus harder, plate.

The midsole lower portion and the midsole upper portion may be made of the same or different material and/or may have the same or different hardness.

The midsole upper portion and the midsole lower portion may be separately produced and connected by material locking, e.g. by gluing and/or welding.

The midsole upper portion and/or the midsole lower portion may each have a thickness which varies along the longitudinal direction. In certain embodiments the thickness of the midsole upper portion and the thickness of the midsole lower portion inversely change along the longitudinal direction of the midsole, e.g. if the thickness of the midsole upper portion becomes larger, the thickness of the midsole lower portion becomes smaller and vice versa.

In some embodiments at least some, but optionally not all, or also all of the slits each extend from the midsole lower portion into the midsole upper portion. In such embodiments the slits may be interrupted by the elastic rigid plate. Thus, the lower part of the slit in the midsole lower portion may extend towards the rigid plate, and the upper part of the slit in the midsole upper portion may extend from the rigid plate towards the top layer of the midsole.

In some embodiments, the elastic rigid plate forms in the cross-section along the longitudinal direction of the midsole and perpendicular to the transverse direction of the midsole a curvature being convexly directed towards the base layer of the midsole. This curvature is preferably arranged in the forefoot and/or the midfoot area of the midsole. Such a curvature has the advantage that the propelling effect of the elastic rigid plate during push-off is significantly increased.

In some embodiments, the viscoelastic block elements are arranged such that the slit between at least a portion, i.e. at least one, or at least two, or a majority, i.e. at least 50%, or all, of directly adjacent viscoelastic block elements extend(s) in the cross-section along the longitudinal direction of the midsole and perpendicular to the vertical direction of the midsole linearly or non-linearly, in particular in a chevron-shape.

In some embodiments, the midsole may comprise a groove extending along at least parts of the longitudinal direction, e.g. at least from the heel region in the midfoot region and optionally into the forefoot region, of the midsole. This groove may typically be open towards the base layer of the midsole, respectively towards the ground in the operative, i.e. worn, state. Such a groove significantly increases the movability of the separate viscoelastic block elements, because it divides each corresponding viscoelastic block element in two portions, i.e. a lateral sided portion and a medial sided portion.

In certain embodiments, the groove comprises a V-shaped cross section, which particularly opens towards the base layer, respectively the ground in the operative state.

In some embodiments, the viscoelastic block elements are arranged such that the slit between at least a portion of directly adjacent viscoelastic block elements extends in the cross-section along the longitudinal direction of the midsole and perpendicular to the vertical direction of the midsole linearly or non-linearly, in particular in a chevron-shape.

In some embodiments, the viscoelastic block elements extend in the cross-section along the longitudinal direction of the midsole and perpendicular to the vertical direction of the midsole linearly or non-linearly, in particular in a chevron-shape.

In particular, at least some or all of the slits may extend in the transverse direction of the midsole in parallel to each other.

In some embodiments, the width of each of the slit, i.e. the distance between two directly adjacent block elements is between 2 mm to 15 mm, in particular between 4 mm to 8 mm.

In some embodiments, the width of the slits may vary from slit to slit along the longitudinal direction of the sole.

In some embodiments, the width of some or of all of the slits may decrease along the transverse direction, in particular from the lateral side to the center of the sole and/or from the medial side to the center of the sole.

In some embodiments, the ratio of the depth to width of each of the slits is between 20:100 to 2000:100, preferably 750:1000 to 750:100.

Typically, the width of each of the slits varies only up to 20%, particularly up to 15%, particularly up to 10%, particularly up to 5% from slit to slit.

In some embodiments, the midsole further comprises, respectively defines one or more channels extending along the transverse direction of the midsole, in particular from the medial side to the lateral side of the midsole. In contrast to a slit, a channel as it is used herein is along the longitudinal and vertical direction, respectively along the plane defined by the longitudinal and vertical direction, completely closed. A slit has at least one opening in the midsole along the longitudinal and/or vertical direction, respectively in the plane defined by the longitudinal and vertical direction. The one or more channels may have a medial opening at the medial side of the midsole and/or a lateral opening at the lateral side of the midsole. Such channels have the advantage that on the one hand, the weight of the midsole can be further reduced, while increasing the cushioning effect of the midsole.

In certain embodiments, the one or more channels have an elongated shape in the cross section along the longitudinal direction and perpendicular to the transverse direction. Thus, the cross section of such a channel has in the plane defined by the longitudinal direction and the vertical direction a length extending along a first direction which is larger than a width extending along another, i.e. second, direction.

In certain embodiments, one or more of such channels is each along the vertical direction arranged above, and preferably also aligned with, a slit defined two adjacent viscoelastic block elements. It is understood that the slit and the channel are separated by midsole material from each other. In specific embodiments, the channel is elongated and represents a continuation of the slit. This means, the channel has the same width as the slit and a rear channel wall is aligned with the front flank of the corresponding viscoelastic block element defining the slit and a front channel wall is aligned with the rear flank of the other corresponding viscoelastic block element defining the slit. It is clear, due to the definition above that the channel and the slit are still separated by midsole material from each other. It is understood that the front channel wall is along the longitudinal direction arranged closer to the sole tip than the corresponding rear channel wall of this channel. Channels representing a continuation of a slit are preferably arranged in the forefoot area. Such channels have the advantage that the slit below them is necessarily shorter, which allows for a more stable push-off. However, at the same time, the channel still allows for an efficient cushioning of forces acting against the longitudinal direction. However, as the channels are completely closed in the plane defined by the longitudinal direction and the vertical direction, a more stable stand is achieved, which provides the runner with a more controlled feeling and a more powerful push-off.

In some embodiments, the one or more channels are arranged offset with respect to the plurality of slits. In particular, the one or more channels are arranged in the vertical direction above the plurality of slits but in the longitudinal direction offset to the plurality of slits. In specific embodiments, the one or more channels being arranged offset with respect to the plurality of slits, may also be slits instead of channels. If the channels are slits, these slits may be referred to as "top layer slits", while the plurality of slits extending from the base layer towards the top layer and being open towards the ground and/or the base layer, may be referred to as "base layer slits". The top layer slits are typically open toward the top layer of the midsole. In some embodiments, the one or more channels and the plurality of slits are in the longitudinal direction alternatingly arranged. Thus, with the exception of the first and last channel and/or slit, each slit is along the longitudinal direction arranged between two channels and/or each channel is along the longitudinal direction arranged between two slits.

In some embodiments, the one or more channels may penetrate the midsole completely from the lateral to the medial side.

Another aspect relates to a shoe comprising a midsole according to any of the embodiments described herein.

In some embodiments, the shoe may further comprise an outsole covering at least parts of or all of the base layer of the midsole. The outsole may for example be made of thermoplastic polyurethane or rubber, particularly natural rubber. In some embodiments, the outsole may be continuous and may in particular extend, e.g. continuously extend over several viscoelastic block elements. Thus, in such embodiments, a slit between such viscoelastic block elements may be covered by the outsole.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims. The drawings are showing:

DETAILED DESCRIPTION OF THE INVENTION

Figure 1:
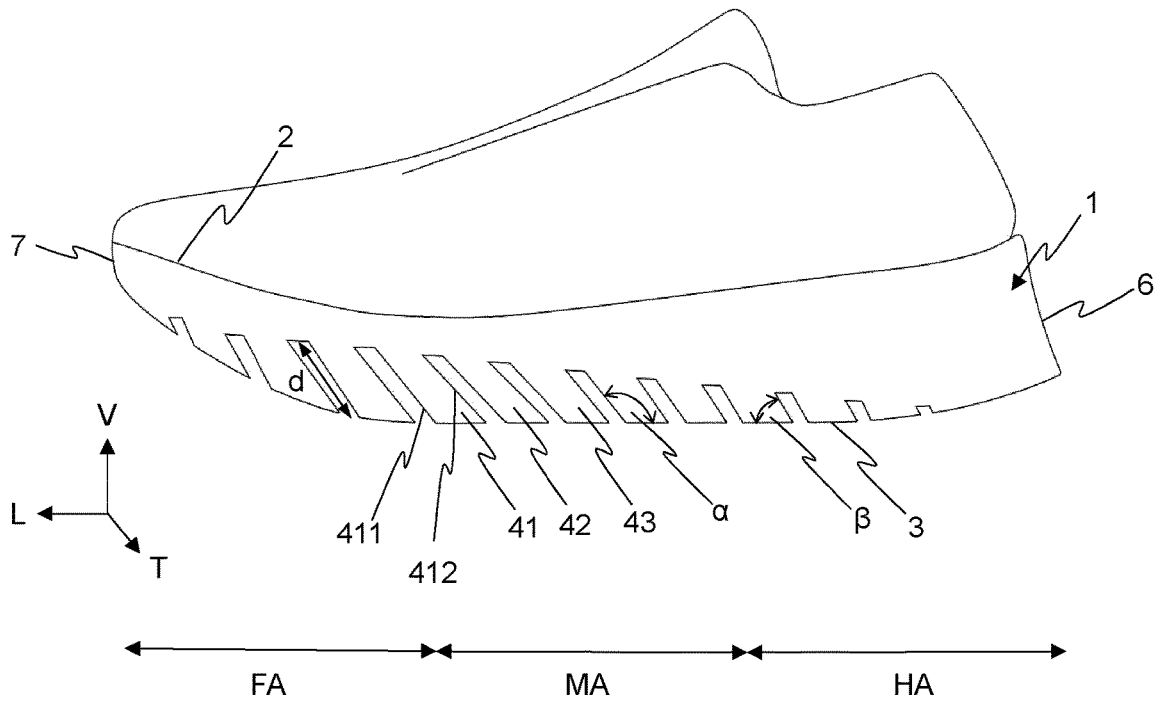
FIG. 1 shows a midsole according to an embodiment of the invention being part of a running shoe.

FIG. 1 shows a midsole 1 being part of a running shoe. Midsole 1 comprises top layer 2 and base layer 3 which delimit the midsole in the vertical direction V. Furthermore, midsole 1 comprises heel edge 6 and sole tip 7 between which midsole 1 extends and which delimit the midsole in the longitudinal direction L. Midsole 1 comprises several viscoelastic block elements 41, 42, 43 (only three are referenced for clarity purposes) which may protrude from top layer 2. As can be seen, along the longitudinal direction L from heel edge 6 to sole tip 7, the viscoelastic block elements are consecutively arranged, i.e. one after the other. They are each separated from the next adjacent viscoelastic block element by a corresponding slit. Each slit has a depth d. Each of these slits extends in the transverse direction T from the medial side of the midsole to the lateral side of the midsole. Furthermore, the viscoelastic block elements and the slits are configured such that base layer 3 and top layer 2 of midsole 1 are along the longitudinal direction L of the midsole sheared against each other, thereby decreasing the distance between directly adjacent viscoelastic block elements, e.g. between at least two or between all directly adjacent viscoelastic block elements, upon exposure to forces occurring during running, which act against the longitudinal direction of the midsole 1. Upon footfall, i.e. contact with the ground, the midsole comes in contact with the ground (either directly or indirectly via an outsole). In this moment forces act horizontally against longitudinal direction L, which moves directly adjacent viscoelastic block elements towards each other, thereby decreasing their distance and the width of the corresponding slit between them, particularly until the corresponding two viscoelastic block elements contact each other.

As can be seen from FIG. 1, the slits between two adjacent viscoelastic block elements are open towards the base layer 3, i.e. in the worn state to the ground. The midsole is divided into a forefoot area FA, a heel area HA and a midfoot area MA being arranged between the forefoot area and the heel area.

Each viscoelastic block element, such as for example viscoelastic block element 41, comprises a front flank such as front flank 411 facing towards sole tip 7 and a rear flank, such as rear flank 412 facing heel edge 6 (for clarity purposes only the front and read flank of element 41 is referenced).

Both the viscoelastic block elements as well as the slits extend from the base layer 3 towards the top layer 2 forward, i.e. in the longitudinal direction and upward, i.e. in the vertical direction V.

FIG. 1 further shows that the angles β between the rear flank and the base layer of the viscoelastic block elements vary from one viscoelastic block element to the next adjacent viscoelastic block element in the longitudinal direction, i.e. from the heel edge of the midsole to sole tip. Starting from the heel edge 6, angle β first remains essentially constant, then decreases from block element to block element, see viscoelastic block element 43, and reaches its minimum at viscoelastic block element 42 after which in the longitudinal direction, the angle β increases again. Correspondingly, the angles α between the front flank and the base layer of the viscoelastic block elements vary from one viscoelastic block element to the next adjacent viscoelastic block element in the longitudinal direction from the heel edge 6 of the midsole to sole tip 7. In the embodiment shown, starting again from heel edge 6, the angle α first remains essentially constant, then increases from block element to block element, for example at viscoelastic block element 43, until it reaches its maximum at viscoelastic block element 42, after which it decreases again in the longitudinal direction towards sole tip 7.

In addition to or also alternatively to angles α and β also the depth d of the slits may vary from slit to slit along the longitudinal direction. From heel edge 6 towards sole tip 7 in the longitudinal direction L, the depth d of the slits may from slit to slit first increase, then reaches a maximum and then decreases again towards sole tip 7.

Figure 2:
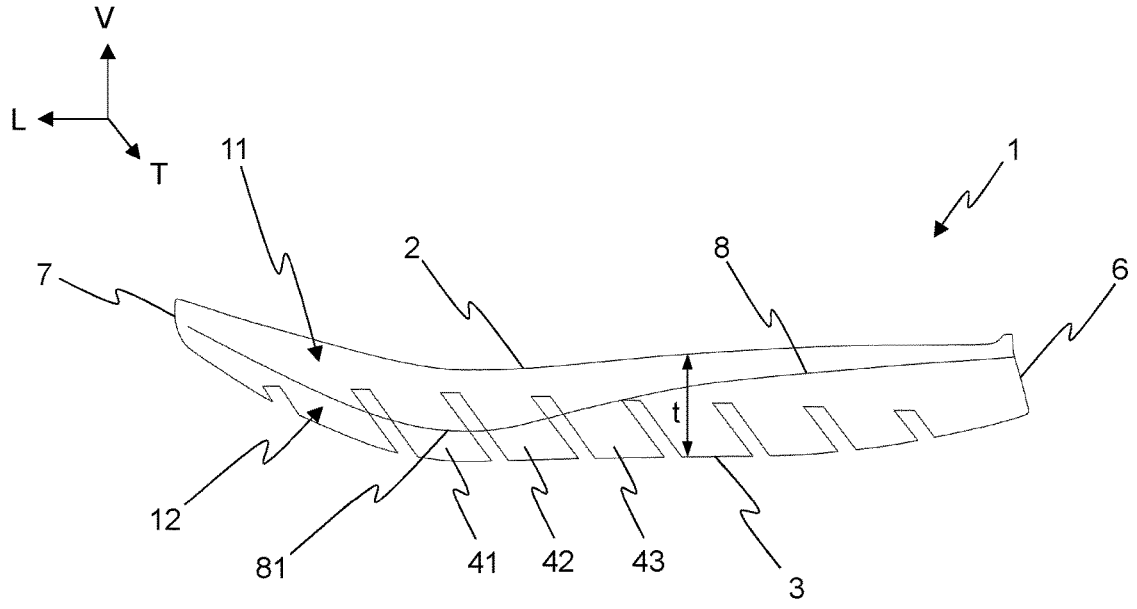
FIG. 2 shows a midsole according to another embodiment of the invention.

FIG. 2 shows midsole 1 according to another embodiment of the invention which comprises also viscoelastic blocking elements 41, 42 and 43, top layer 2 and base layer 3 as described for the embodiment shown in FIG. 1. In contrast to the embodiment shown in FIG. 1, the midsole 1 shown in FIG. 2 further comprises elastic rigid plate 8 which divides midsole 1 in midsole upper portion 11 and midsole lower portion 12, between which the elastic rigid plate 8 is sandwiched. The total thickness t of the midsole, i.e. its extension in the vertical direction V, consists of the sum of thicknesses of midsole upper portion 11, of the midsole lower portion 12 and of the elastic rigid plate 8. As can be seen, some of the slits, for example the slits between viscoelastic block elements 41 and 42 or between viscoelastic block elements 42 and 43 extend from midsole lower portion 12 into midsole upper portion 11 and are interrupted by elastic rigid plate 8. This provides an additional stabilizing effect on the stand and/or footstep. Elastic rigid plate 8 further comprises curvature 81 in the forefoot area, in particular its vertex may generally be arranged in the forefoot or midfoot area, which is convexly arranged with respect to, i.e. convexly directed towards, base layer 3.

Figure 3A:
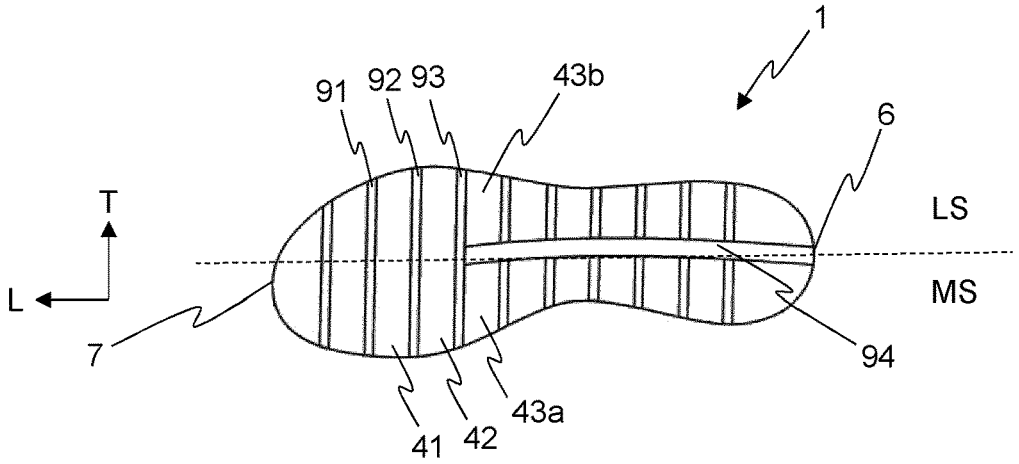
FIG. 3*a* shows a midsole according to other embodiments of the invention.
Figure 3B:
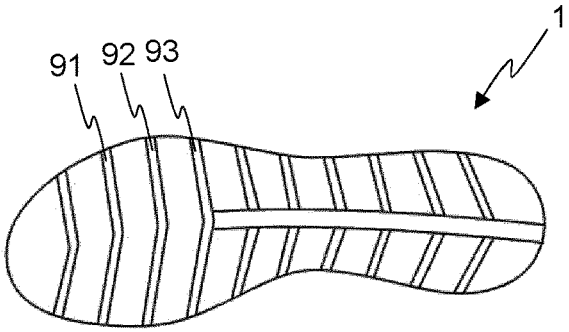
FIG. 3*b* shows a midsole according to another embodiment of the invention.

FIGS. 3*a* and 3*b* show views onto the base layer of a midsole 1 according to other embodiments of the invention. The midsole 1 shown in FIG. 3*a* comprises viscoelastic block elements 41, 42, 43*a* and 43*b* as it has been described for FIG. 1. These blocking elements are separated from each other by slits 91, 92, 93 (for clarity purposes, only 3 viscoelastic block elements and only 3 slits between them are referenced). Each slit extends in transverse direction T from the medial side MS to the lateral side LS of the midsole. In this particular embodiment, the slits extend linearly and perpendicular to the longitudinal direction L. Midsole 1 further comprises single groove 94 extending along the longitudinal direction of the midsole from heel edge 6 through the heel area and the midfoot area, but in this embodiment not into the forefoot area. Groove 96 divides viscoelastic block element 43 into medial sided portion 43*b* and lateral sided portion 43*a* of viscoelastic block element 43. Groove 6 is open towards the base layer of the midsole, i.e. in FIG. 3*a* towards the observer.

FIG. 3*b* shows a closely related embodiment to midsole 1 shown in FIG. 3*a*. In contrast to FIG. 3*a*, slits such as slits 91, 92 and 93, as well as the viscoelastic block elements extend in the cross-section along the longitudinal direction L of the midsole 1 and perpendicular to the vertical direction of the midsole in a chevron-shape.

Figure 4:
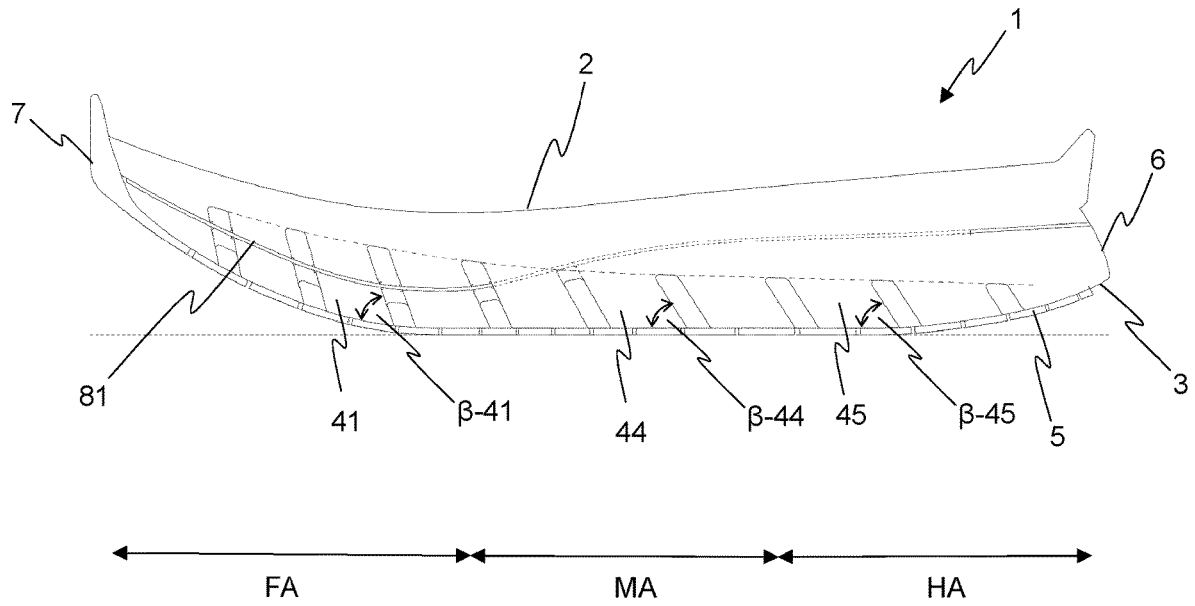
FIG. 4 shows a part of a shoe with a midsole according to another embodiment of the invention.

FIG. 4 shows another embodiment of a shoe with midsole 1 (the upper is not shown) according to the invention. Midsole 1 comprises several viscoelastic block elements 41 in the forefoot area FA, 44 in the midfoot area MA and 45 in the heel area HA (only three are referenced for clarity purposes) which may protrude from top layer 2. Base layer 3 of the midsole is additionally covered by outsole 5 of the shoe. The angles β-41, β-44, and β-45 between the corresponding rear flank of each of the viscoelastic block elements 41, 44, 45 and base layer 3 may from the heel tip along the longitudinal direction first decrease from one viscoelastic block element to the directly adjacent one until a minimum angle is reached at viscoelastic block element 44 in the midfoot area and then the angles between the rear flank and the base layer of the viscoelastic block elements increase again towards sole tip 7.

Figure 5:
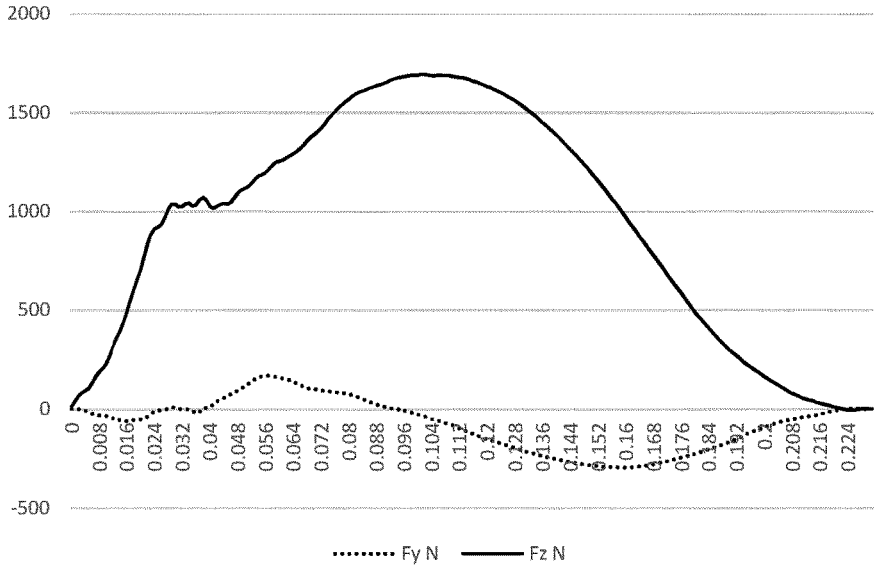
FIG. 5 shows a force curve for the vertically acting force (FZ) and for the horizontally acting force (FY) on the midsole during one tread/push-off cycle.

FIG. 5 shows a force diagram of the vertical force FZ (continuous line) and the horizontal force FY (dashed line) acting on the midsole during one tread/push off cycle. The y-axis shows the measured force in N and the x axis the time in s. The measurement was conducted as follows: A test subject (male, 70 kg with shoe size US 10) runs down a determined track, at the determined speed of 12 km/h and steps with only the right foot on a force plate. Footstrike (tread) and full stance is being videotaped via a high speed camera placed orthogonally to the direction of locomotion and synchronized with the force plate data acquisition. For the measurement a KISTLER Type 9260AA 3D force plate (sampling frequency 1000 Hz), KISTLER BIO WARE (data processing software), a PHANTOM High Speed Camera (sampling frequency 1000 Hz) and KINOVEA 0.9.4 (data processing software) was used.

Figure 6:
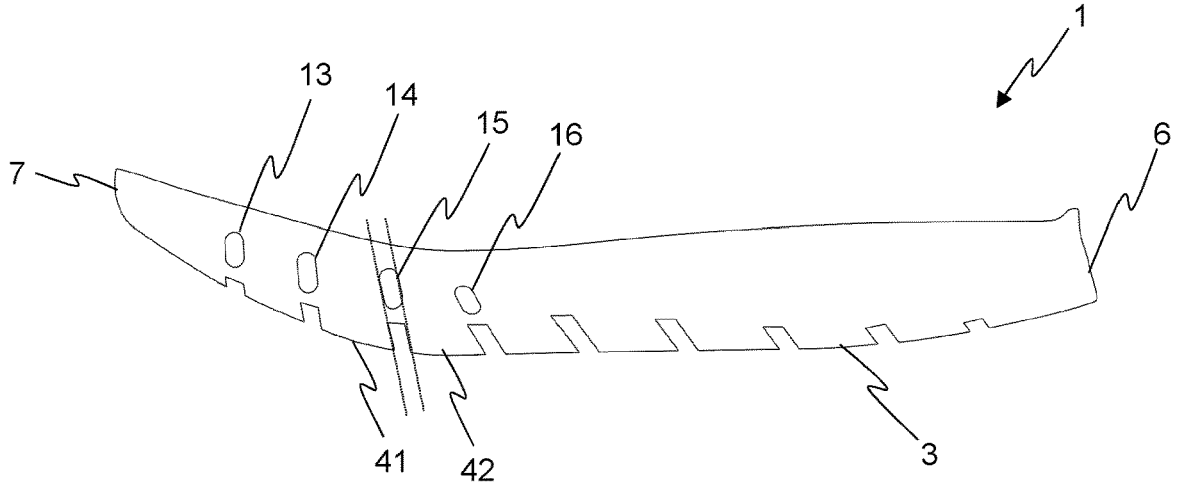
FIG. 6 shows a midsole according to another embodiment of the invention.

FIG. 6 shows a midsole 1 according to another embodiment of the invention. Midsole 1 comprises several viscoelastic block elements (only 41 and 42 are referenced for clarity purposes). In contrast to the midsole shown in FIG. 2 however, midsole 1 further comprises channels 13, 14, 15 and 16 extending along the transverse direction of the midsole, which each have an opening on the medial side of the midsole. As can be seen, the channels each have an elongated shape and each channel is arranged along the vertical direction above a corresponding slit. For example, channel 15 is arranged above the slit being defined by viscoelastic block elements 41 and 42. Furthermore channel 15 represents a continuation of this slit, i.e. the channel width of channel 15 is equal to the width of the corresponding slit and the front wall of channel 15 is aligned with the rear flank of viscoelastic block element 41, while the rear wall of channel 15 is aligned with the front flank of channel 42 (see the dashed lines).

Figure 7:
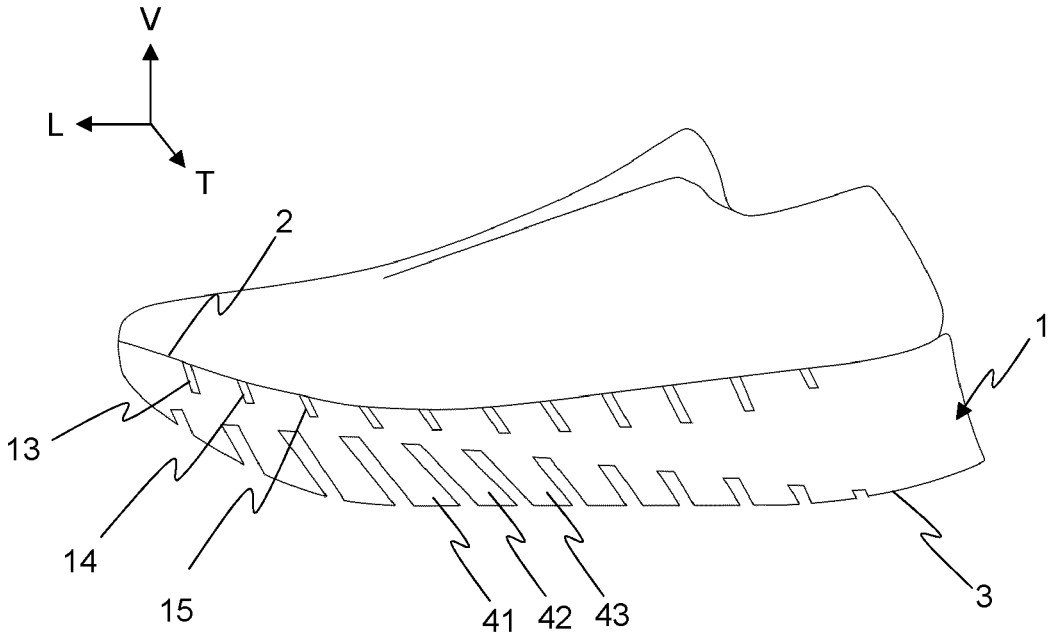
FIG. 7 shows a shoe with a midsole according to another embodiment of the invention

FIG. 7 shows a shoe with a midsole 1 according to another embodiment of the invention. In contrast to the shoe shown in FIG. 1, midsole 1 of FIG. 7 comprises in addition to the plurality of slits 41, 42, 43 (only 41, 42 and 43 are referenced for clarity purposes), which may be referred to as "base layer slits" a plurality of channels or slits 13, 14 and 15 (only 13, 14 and 15 are referenced for clarity purposes) which are vertically arranged above the plurality of slits 41, 42 and 43 and in the longitudinal direction offset to the plurality of slits 41, 42 and 43. Slits 13, 14 and 15 may be referred to as "top layer slits". Thus, in contrast to the embodiment shown in FIG. 6, channels or slits 13, 14 and 15 are not aligned with the plurality of slits 41, 42 and 43.

The invention claimed is:

1. A sole for a running shoe extending in a longitudinal direction (L), a vertical direction (V) and a transverse direction (T), the sole comprising a midsole (1) comprising:

a. a top layer (2) and a base layer (3) delimiting the midsole in the vertical direction (V); a heel edge (6) and a sole tip (7) delimiting the midsole in the longitudinal direction (L); and a medial side and a lateral side delimiting the midsole in the transverse direction (T);

b. a plurality of separate viscoelastic block elements (41, 42, 43) arranged along the longitudinal direction (L) of the midsole (1) one after the other, wherein the viscoelastic block elements (41, 42, 43) are distanced from each other by a plurality of slits, wherein each slit extends in the transverse direction (T) from the medial side of the midsole (1) to the lateral side of the midsole (1);

c. an elastic rigid plate (8), wherein the elastic rigid plate divides the midsole into a midsole upper portion and a midsole lower portion, wherein at least some of the slits extend from the midsole lower portion into the midsole upper portion and are interrupted by the elastic rigid plate; and d. the sole further comprising an outsole covering at least parts of the base layer of the midsole, wherein the outsole extends over several viscoelastic block elements, wherein one or more of the plurality of slits extend from the outsole into contact with the elastic rigid plate (8);

wherein the viscoelastic block elements (41, 42, 43) and the slits are configured such that the base layer (3) and the top layer (2) of the midsole (1) are shearable against each other along the longitudinal direction (L) of the midsole (1), thereby decreasing the distance between directly adjacent viscoelastic block elements (41, 42, 43) upon exposure to forces occurring during running, which act against the longitudinal direction (L) of the midsole (1).

2. The midsole (1) according to claim 1, wherein the viscoelastic block elements (41, 42, 43) and the slits are configured such that the base layer (3) and the top layer (2) of the midsole (1) are along the longitudinal direction (L) of the midsole (1) sheared against each other until directly adjacent viscoelastic block elements (41, 42, 43) contact each other, under closure of the slit separating and distancing the directly adjacent viscoelastic block elements (41, 42, 43), upon exposure to forces occurring during running, which act against the longitudinal direction (L) of the midsole (1).

3. The midsole (1) according to claim 1, wherein each viscoelastic block element (41, 42, 43) comprises a front flank (411) delimiting the viscoelastic block element (41, 42, 43) in the longitudinal direction (L) and a rear flank (412) delimiting the viscoelastic block element (41, 42, 43) against the longitudinal direction (L), wherein the front flank (411) and the rear flank (412) of at least a portion of the viscoelastic block elements (41, 42, 43) linearly extend from the base layer (3) in the vertical direction (V) towards the top layer (2) of the midsole (1) and in the longitudinal direction (L) towards the sole tip (7).

4. The midsole (1) according to claim 3, wherein at least a portion of the viscoelastic block elements (41, 42, 43) each has in the cross-section along the longitudinal direction (L) of the midsole (1) and perpendicular to the transverse direction (T) of the midsole (1) a shape of at least one of a trapezoid and a parallelogram; and/or wherein the front flank (411) and the rear flank (412) of at least one of the viscoelastic block elements (41, 42, 43) are arranged in parallel to each other.

5. The midsole (1) according to claim 3, wherein angles (β) between the rear flank (412) and the base layer (3) of the viscoelastic block elements (41, 42, 43) vary from one viscoelastic block element to the next adjacent viscoelastic block element in the longitudinal direction (L) from the heel edge (6) of the midsole to sole tip (7); and/or wherein angles (a) between the front flank (411) and the base layer (412) of the viscoelastic block elements (41, 42, 43) vary from one viscoelastic block element to the next adjacent viscoelastic block element in the longitudinal direction (L) from the heel edge (6) of the midsole (1) to sole tip (7).

6. The midsole (1) according to claim 3, wherein an angle (β) between the rear flank (412) and the base layer (3) is between 15° and <90°; and/or wherein an angle (α) between the front flank (411) and the base layer (3) is between 165° and >90°.

7. The midsole (1) according to claim 1, wherein the slits have a varying depth (d), wherein the depth (d) of the slits may first increase from a heel edge (6) of the midsole (1) along the longitudinal direction (L) and then decrease to the sole tip (7) of the midsole (1).

8. The midsole (1) according to claim 1, wherein the depth (d) of at least a portion of the slits is larger than 30% of the thickness of the midsole (1).

9. The midsole (1) according to claim 1, wherein the distance between directly adjacent viscoelastic block elements (41, 42, 43) defining a slit width varies along the longitudinal direction (L) of the midsole (1).

10. The midsole (1) according to claim 1, wherein a ratio between a total closed area and a total open area being defined by the slits along the lateral side of the midsole (1) or along the medial side of the midsole (1) is between 0.95:0.05 to 0.75:0.25.

11. The midsole (1) according to claim 1, wherein the elastic rigid plate (8) forms in the cross-section along the longitudinal direction (L) of the midsole (1) and perpendicular to the transverse direction (T) of the midsole (1) a curvature (81) being convexly directed towards the base layer (3) of the midsole (1), in a forefoot (FA) and/or midfoot area (MA) of the midsole (1).

12. The midsole (1) according to claim 1, wherein the viscoelastic block elements (41, 42, 43) are arranged such that the slit between at least a portion of directly adjacent viscoelastic block elements (41, 42, 43) extends in the cross-section along the longitudinal direction (L) of the midsole (1) and perpendicular to the vertical direction (V) of the midsole (1) linearly or non-linearly.

13. The midsole (1) according to claim 1, wherein the viscoelastic block elements (41, 42, 43) are arranged such that the slit between at least a portion of directly adjacent viscoelastic block elements (41, 42, 43) extends in the cross-section along the longitudinal direction (L) of the midsole (1) and perpendicular to the vertical direction (V) of the midsole (1) in a chevron-shape.

14. The midsole (8) according to claim 1, wherein the midsole may be made from at least two pieces.

15. The midsole (8) according to claim 1, wherein the elastic rigid plate delimits the midsole in a vertical direction.

16. The midsole (8) according to claim 1, wherein one or more of the slits are covered by the outsole.

17. The midsole (8) according to claim 1, wherein one or more of the plurality of slits extend from the outsole up to the elastic rigid plate (8).

18. A sole for a running shoe extending in a longitudinal direction (L), a vertical direction (V) and a transverse direction (T), the sole comprising a midsole (1) comprising:

a. a top layer (2) and a base layer (3) delimiting the midsole in the vertical direction (V); a heel edge (6) and a sole tip (7) delimiting the midsole in the longitudinal direction (L); and a medial side and a lateral side delimiting the midsole in the transverse direction (T);

b. a plurality of separate viscoelastic block elements (41, 42, 43) arranged along the longitudinal direction (L) of the midsole (1) one after the other, wherein the viscoelastic block elements (41, 42, 43) are distanced from each other by a plurality of slits, wherein each slit extends in the transverse direction (T) from the medial side of the midsole (1) to the lateral side of the midsole (1);

c. an elastic rigid plate (8), wherein the elastic rigid plate divides the midsole into a midsole upper portion and a midsole lower portion, wherein at least some of the slits extend from the midsole lower portion into the midsole upper portion and are interrupted by the elastic rigid plate; and d. the sole further comprising an outsole covering parts of or all of the base layer of the midsole, wherein the outsole extends over several viscoelastic block elements, wherein one or more of the plurality of slits extend entirely between the outsole and the elastic rigid plate (8).

* * * * *